US007292203B2

(12) United States Patent
Craggs et al.

(10) Patent No.: US 7,292,203 B2
(45) Date of Patent: Nov. 6, 2007

(54) HELIX ANTENNA

(75) Inventors: John Stanley Craggs, Kenthurst (AU); Christopher Boyce Meulman, North Turramurra (AU)

(73) Assignee: Thiss Technologies Pte Ltd., Singapore (SG)

( * ) Notice: Subject to any disclaimer, the term of this patent is extended or adjusted under 35 U.S.C. 154(b) by 0 days.

(21) Appl. No.: 10/517,499

(22) PCT Filed: Jun. 3, 2003

(86) PCT No.: PCT/AU03/00690

§ 371 (c)(1),
(2), (4) Date: Jul. 26, 2005

(87) PCT Pub. No.: WO03/107483

PCT Pub. Date: Dec. 24, 2003

(65) Prior Publication Data

US 2006/0001591 A1 Jan. 5, 2006

(30) Foreign Application Priority Data

Jun. 12, 2002 (AU) ..... PS2908
Apr. 30, 2003 (AU) ..... 2003902112

(51) Int. Cl.
*H01Q 1/36* (2006.01)

(52) U.S. Cl. ..... 343/895

(58) Field of Classification Search ..... 343/895
See application file for complete search history.

(56) References Cited

U.S. PATENT DOCUMENTS 4,012,740 A 3/1977 Lenneper
4,012,744 A 3/1977 Greiser
4,429,314 A * 1/1984 Albright ..... 343/788
5,041,842 A 8/1991 Blaese
5,345,248 A 9/1994 Hwang et al.
5,479,182 A 12/1995 Sydor
5,754,146 A 5/1998 Knowles et al.
6,112,102 A * 8/2000 Zhinong ..... 455/552.1
6,115,005 A 9/2000 Goldstein et al.
6,133,891 A 10/2000 Josypenko

FOREIGN PATENT DOCUMENTS

EP 0 528 775 2/1993
GB 1 507 836 4/1978

OTHER PUBLICATIONS

Patent Abstracts of Japan of JP 08-078946 dated Mar. 22, 1996.
Patent Abstracts of Japan of JP 2001-094333 dated Apr. 6, 2001.
Patent Abstracts of Japan of JP 05-251919 dated Sep. 28, 1993.

(Continued)

*Primary Examiner*—Michael C. Wimer
(74) *Attorney, Agent, or Firm*—Ladas & Parry LLP

(57) ABSTRACT

An antenna element is disclosed, having a ground plane (106), a helix (104) disposed above the ground plane (106), the helix (104) being connectable to a communications apparatus at a helix end (214) located near the ground plane (106), and a spiral (102) substantially centred on the axis (100) of the helix (104) the spiral (102) having an outer end thereof connected to the other helix end, said spiral (102) thereby terminating the antenna.

16 Claims, 14 Drawing Sheets

OTHER PUBLICATIONS

Nakano, H., et al. "Extremely Low-Profile Helix Radiating a Circularly Polarized Wave" *IEEE Transactions on Antennas and Propagation* (1991) vol. 39, No. 6, pp. 754-757.
Jordan, E. "Electromagnetic Waves and Radiating Systems: Principles of Broadband Antenna Design", Second Edition, *Prentice Hall International Editions*, pp. 601-605.
Evans, D.S., et al. "VHF-UHF Manual: Aerials" Third Edition, *RSGB Publication*, pp. 7.21-7.22.
Nakano, H., et al. "Extremely Low-Profile Helix Radiating a Circularly Polarized Wave" *IEEE Transactions on Antennas and Propagation*, vol. 39, No. 6, pp. 754-757, Jun. 1991.
Jordan, E. "Electromagnetic Waves and Radiating Systems: Principles of Broadband Antenna Design", Second Edition, *Prentice Hall International Editions*, pp. 601-605, 1968.
Evans, D.S., et al. "VHF-UHF Manual: Aerials" Third Edition, *RSGB Publication*, pp. 7.21-7.22, 1976.

* cited by examiner

HELIX ANTENNA

FIELD OF THE INVENTION

The present invention relates generally to antennas and, in particular, to helical antennas.

BACKGROUND

In Mobile Satellite System (MSS) networks, antenna performance at the mobile terminal is critical in determining the performance of the overall system. Considerable development work has thus been performed globally relating to performance and implementation of antenna designs that are suitable for terminals in such networks.

Patch antennas were initially considered because of their low physical profiles, and their theoretical peak gains of greater than 7 dB. In practical implementations, however, much lower peak gains were achieved. Furthermore, these antennas have narrow frequency bandwidth performance, and poor axial ratio performance at off-boresite angles, thus typically limiting their coverage to 25 degree elevation angles.

The aforementioned low antenna gain has been addressed by using phased array techniques which involve driving multiple antenna elements in parallel using a phased drive network. This enables higher overall antenna gain to be achieved while accepting lower gains from the individual antenna elements. High gain phased-array antenna arrangements using patches, with either manual or automatic antenna pointing, can typically provide between 9 dB and 18 dB of antenna gain. The phased array drive networks introduce undesirable losses into the antenna arrangements, however, and are complex to design across a broad range of operating frequency.

Low gain passive antennas using multifilar helices or patch elements have been used in MSS networks, typically exhibiting antenna gains up to 6 dB.

SUMMARY

An antenna concept disclosed herein provides a simple medium gain antenna, based on a low profile helix terminated with a spiral. The antenna offers significantly higher antenna gain than patch antenna arrangements.

According to a first aspect of the invention, there is provided an antenna element comprising:

a ground plane;

a helix disposed above the ground plane, the helix being connectable to a communications apparatus at a helix end located near the ground plane; and a spiral substantially centred on the axis of the helix the spiral having an outer end thereof connected to the other helix end, said spiral thereby terminating the antenna.

According to another aspect of the invention, there is provided an antenna comprising:

a phased array feed network having an equipment feed-line for connection to communication apparatus and a plurality of element feed-lines for connection to a like plurality of antenna elements, said phased array feed network being adapted to collectively connect said plurality of antenna elements to the communication apparatus; and said plurality of helix antenna elements arranged in a domino pattern, each said helix antenna element comprising a ground plane, and a helix disposed above the ground plane, the helix being connectable to a communications apparatus at a helix end located near the ground plane, each said helix antenna element being individually connectable at a respective helix end located near the ground plane to a respective element feed-line of the phased array feed network to thereby connect to the communications apparatus.

According to another aspect of the invention, there is provided an antenna comprising:

a ground plane;

a plurality of helix elements disposed above the ground plane, each said helix being connectable, via a respective feed line of an associated phased array feed network to a communications apparatus, at a helix end located near the ground plane; and a like plurality of spirals, each substantially centred on the axis of the corresponding one of the plurality of helix elements, said each spiral having an outer end thereof connected to the other helix end of the corresponding one of the plurality of helix elements, said spiral thereby terminating the corresponding helix element.

According to another aspect of the invention, there is provided an antenna comprising:

a ground plane:

a plurality of helix elements disposed above the ground plane, each said helix being connectable, via a respective feed line of an associated switched element feed network to a communications apparatus, at a helix end located near the ground plane; and a like plurality of spirals, each substantially centred on the axis of the corresponding one of the plurality of helix elements, said each spiral having an outer end thereof connected to the other helix end of the corresponding one of the plurality of helix elements, said spiral thereby terminating the corresponding helix element.

According to another aspect of the invention, there is provided an antenna comprising:

a phased array feed network having an equipment feed-line for connection to communication apparatus and a plurality of element feed-lines for connection to a like plurality of antenna elements, said phased array feed network being adapted to collectively connect said plurality of antenna elements to the communication apparatus; and said plurality of helix antenna elements being disposed above said ground plane and arranged in a rectangular grid pattern having a first spacing between rows of said rectangular grid pattern and a second spacing between columns of said rectangular grid pattern, each said helix antenna element being individually connectable at a respective helix end located near the ground plane to a respective element feed-line of the phased array feed network to thereby connect to the communications apparatus.

According to another aspect of the invention, there is provided a method of impedance matching an antenna element wherein the antenna element comprises a ground plane, a helix disposed above the ground plane, the helix being connectable to a communications apparatus at a helix end located near the ground plane, and a spiral substantially centred on the axis of the helix the spiral having an outer end thereof connected to the other helix end, said spiral thereby terminating the antenna, said method comprising the steps of:

adjusting a distance, from the ground plane, of the helix end located near the ground plane to thereby adjust the impedance of a tapered transmission line formed between the ground plane and a first quarter turn of the helix.

Other aspects of the invention are also disclosed.

BRIEF DESCRIPTION OF THE DRAWINGS

One or more embodiments of the present invention will now be described with reference to the drawings, in which.

DETAILED DESCRIPTION INCLUDING BEST MODE

Figure 1:
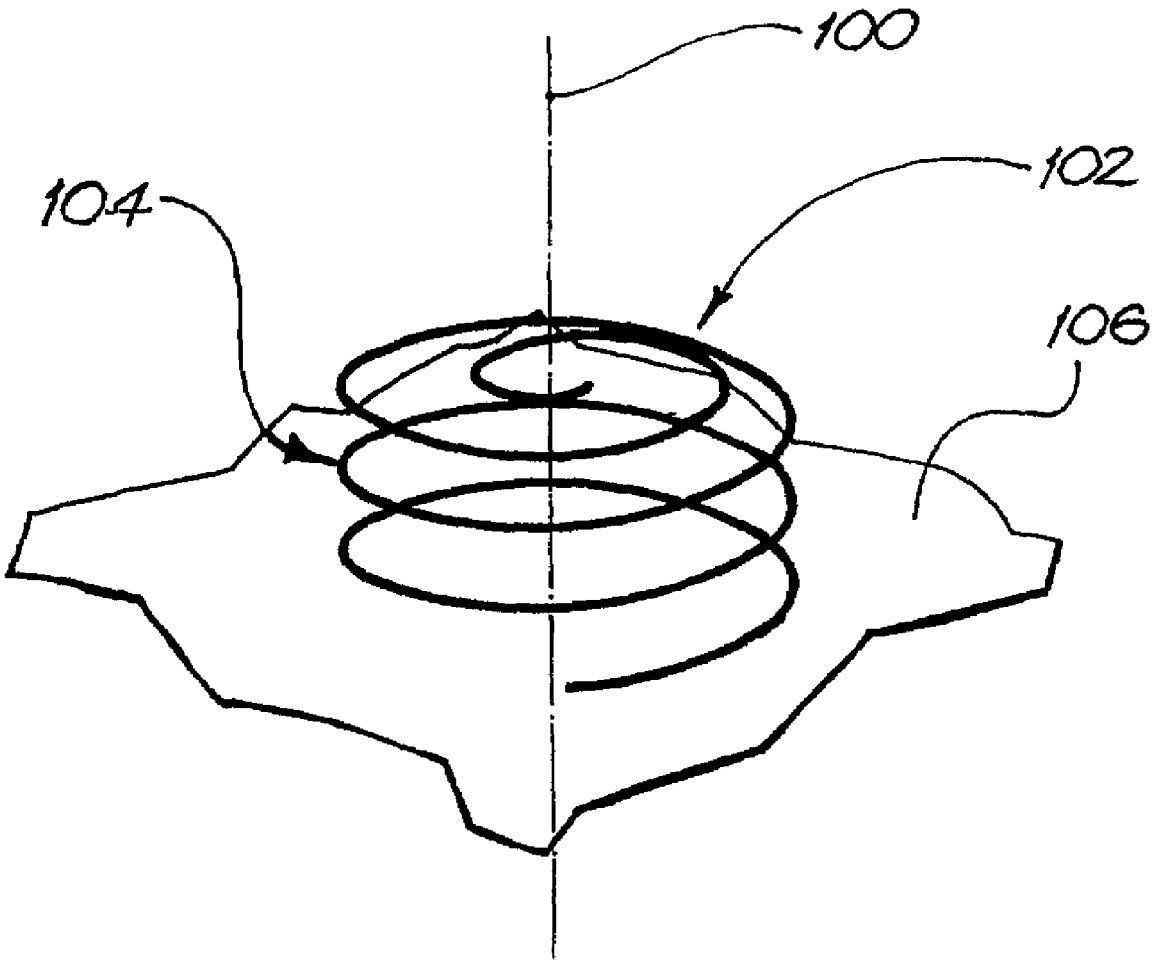
FIG. 1 shows the disclosed helix antenna.

Where reference is made in any one or more of the accompanying drawings to steps and/or features, which have the same reference numerals, those steps and/or features have for the purposes of this description the same function(s) or operation(s), unless the contrary intention appears.

FIG. 1 shows the disclosed helix antenna. The antenna comprises a conductive ground plane 106 above which is disposed a helical coil 104 (alternately referred to in this description as a "helix", a "helical coil" or the like) that is electrically terminated at the upper end of the helix 104 with a spiral 102. The helix antenna is depicted as having a vertical axis 100.

In a preferred embodiment, the helical coil 104 comprises between 1.5 and 3.5 turns. However, other numbers of turns can be used. Furthermore, the helix 104 is approximately one wavelength plus minus 10% of a wavelength in circumference. In addition, the spiral 102 comprises between 2 and 4 turns, in a flat configuration normal to the axis 100.

Although the ground plane 106 is depicted as having a circular shape in FIG. 1, in fact the extent of the ground plane 106 is not critical, provided that it has an area greater than two thirds of a wavelength in diameter.

Figure 2:
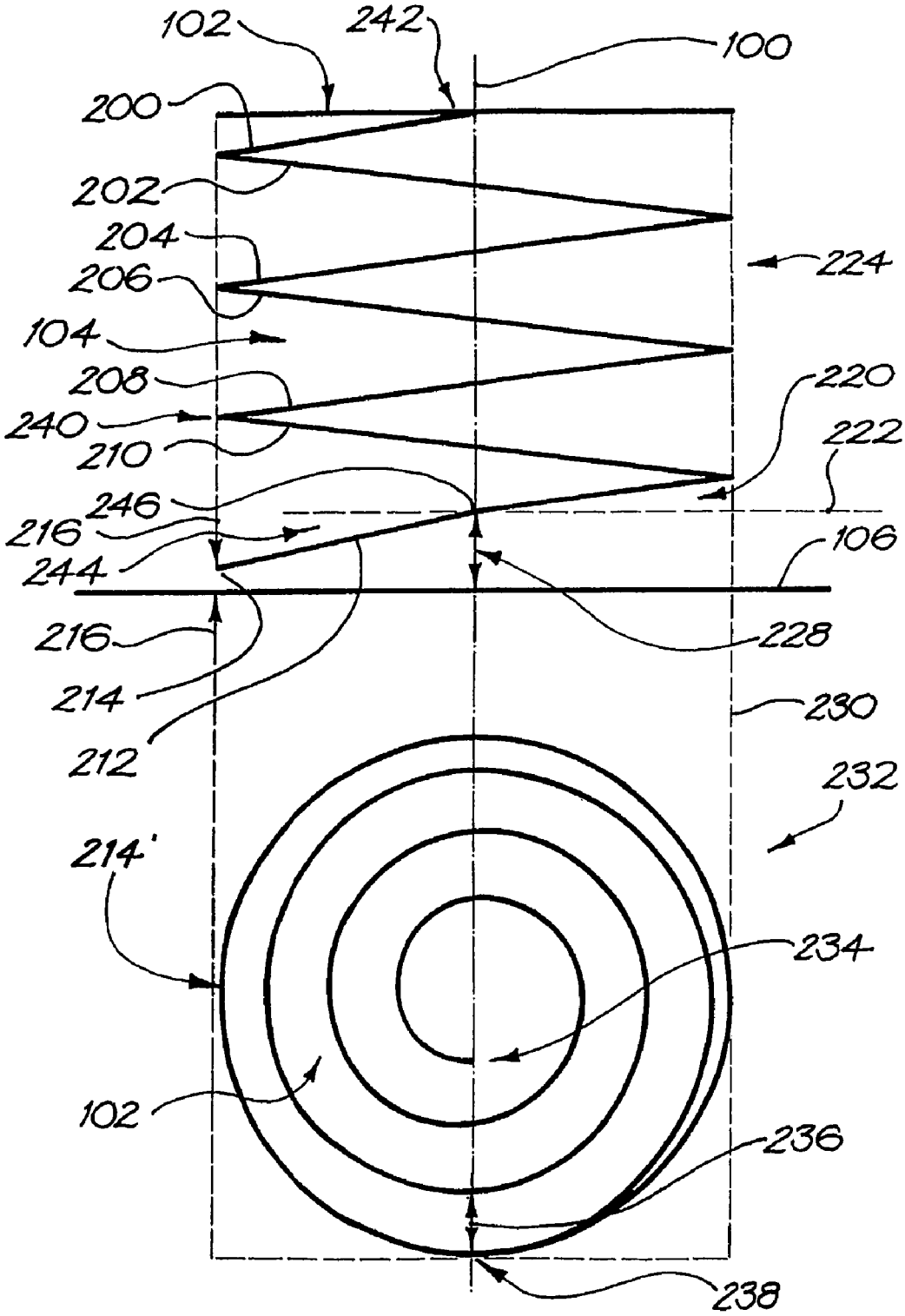
FIG. 2 shows side and plan views of the antenna.

FIG. 2 shows a side view 224 of the helix 104 and the spiral 102, and also a plan view 232 thereof. Turning to the side view 224 the helix 104 has a first end 214 that is disposed a distance 216 above the ground plane 106. This first end 214 of the helix 104 has a radial position about the axis 100 as depicted by a reference numeral 214' in the plan view 232.

The helix 104, when wound in a clock-wise direction produces right hand circular polarization, and when wound in a counter-clockwise direction, produces left hand circular polarization. The number of turns of the helix can typically vary between 1.5 and 3.5, however the number of turns can be varied outside these limits.

The helix 104 in FIG. 2 depicts one example of a helix being wound in a counter-clockwise direction commencing from the first end 214 and comprises three and a quarter turns. The three and a quarter turns comprise a first turn 212-210, a second turn 208-206, a third turn 204-202, and a final quarter turn 200. The final quarter turn 200 of the helix 104 runs from a radial position depicted by the arrow 214' to a radial position depicted by the arrow 238 which is the upper end of the helix 104. The upper end of the helix is connected to the outer end of the spiral 102 at a radial position 238.

The first quarter turn of the helix 104, which extends from the first end 214 to a point 246, describes an angle 244 with respect to a dashed line 222. The remainder of the helix 104 is uniformly wound with a pitch angle 220, which can vary between 3 and 7 degrees, referred to the horizontal reference line 222. The angle 244 can be adjusted to achieve a desired impedance at the input of the helix 104. Although the angle is depicted as being greater than the pitch angle 220, this is illustrative only, and other angles can be adopted according to the desired impedance. Furthermore, although an abrupt change between the angles 244 and 220 occurs at the point 246 in FIG. 2, in practice a smooth angular transition can be used.

The angle 244, together with the distance 216 of the helix first end 214 from the ground plane 106 establishes a distance 228 which is located a quarter turn from the helix first end 214. The radial location of the distance 228 is depicted by the reference numeral 238 in the plane view 232. The one quarter turn segment of the helix 104 between 214 and 238 forms a tapered transmission line with the ground plane 106. As noted, the distance 216 can be advantageously adjusted, for example by adjusting the angle 244, in order to match an input impedance of the helix 104 as desired.

The helix 104 has a second end 242 that is situated, in the present arrangement, three and a quarter turns from the first end 214 of the helix 104. The spiral 102 is connected by an outer end there of to the second end 242 of the helix 104 at a radial location depicted by the reference numeral 238. The spiral 102 has a uniform inter-turn pitch distance 236, and spirals inwards from the aforementioned outer end that is connected to the second end 242 of the helix, to an inner end 234 of the spiral 102. Other types of spiral can also be used.

In a preferred arrangement the spiral 102 is located in a plane horizontal to the axis 100. The spiral 102 can however, in other arrangements, be formed to have a conical shape pointing either upwards or downwards.

Instead of a tapered transmission line being formed using the one quarter turn segment of the helix 104 between 214 and 238 and the ground plane 106, other impedance matching techniques such as quarter wave transmission line matching sections can be used to connect the first end 214 of the helix 104 to the intended communication apparatus thereby achieving the desired impedance matching.

The helix can be made of wire, wound on a low loss, low dielectric constant former to support the helix and spiral. Alternately, the helix can be etched in copper on a thin low loss dielectric film which is then rolled to form a cylinder. Either method provides the necessary mechanical support for reliable operation and causes minimal disturbance to the radiated wave.

This antenna element can be advantageously used in the frequency band between 1 GHz and 8 GHz, however it can also be used outside this frequency band. Furthermore, the addition of the spiral 102 to terminate the helix 104 is found to provide improved beam shaping and a significant decrease in the antenna axial ratio. The antenna is ideally suited for two-way communications via satellite to vehicles, vessels or aircraft. The antenna is a compact, low profile radiator exhibiting circular polarisation, making it ideally suited for use where size and performance are paramount such as in marine, aeronautical and land transport services.

Figure 3:
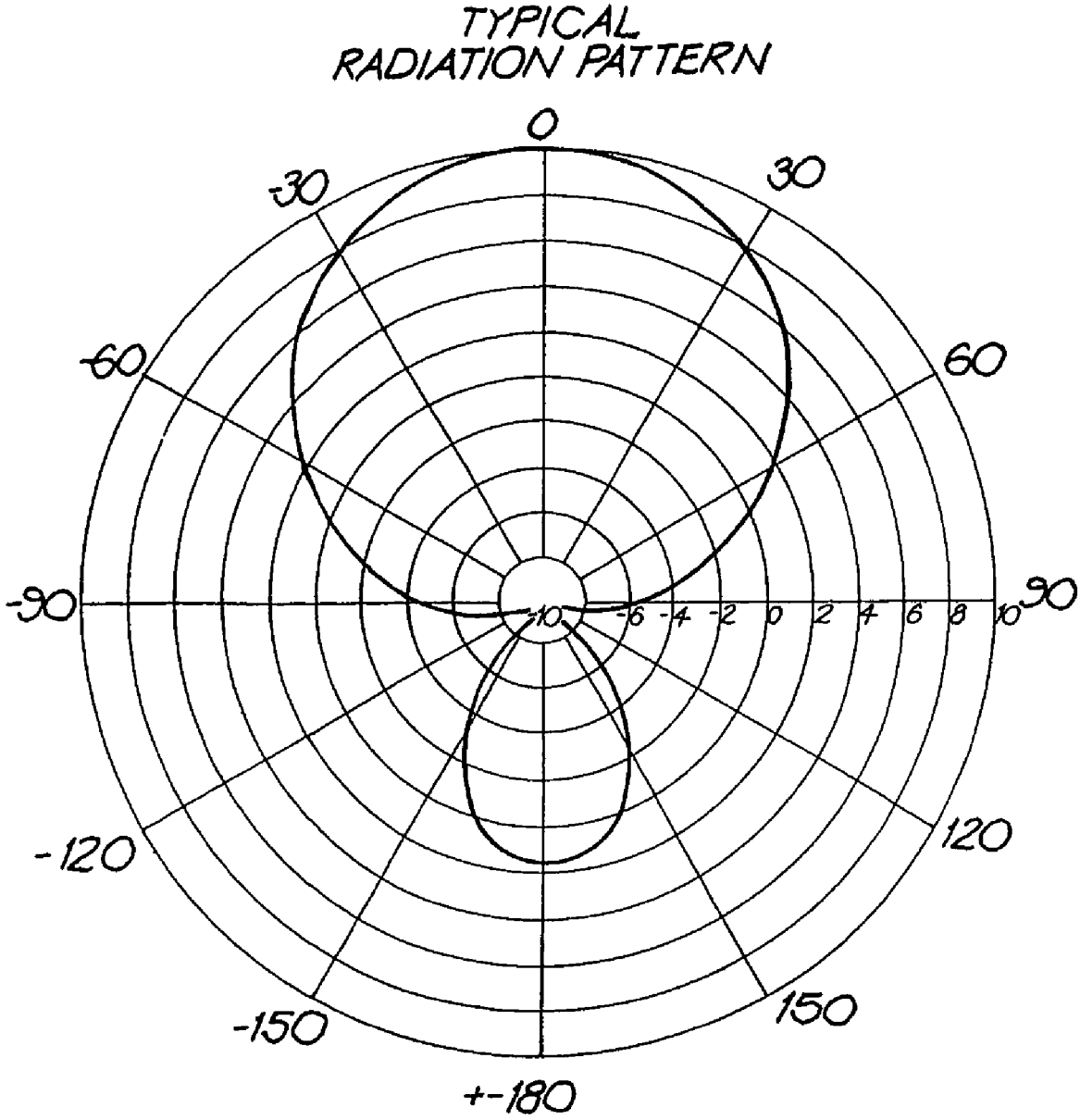
FIG. 3 shows a typical azimuth radiation pattern for the antenna.

FIG. 3 shows a typical radiation pattern for the antenna of FIG. 1, which is seen to have high radiated power gain compared to other types of antenna of similar dimensions.

The antenna of FIG. 1 has a low profile and a compact structure, thereby making it an ideal radiator when used alone. It can also be used as a radiating element in an antenna array. A further advantage is that since the antenna provides higher individual antenna gains than, for example, patch antenna elements, the complex phasing networks that are required in order to drive multiple antenna elements in a phased array can be replaced with a simple low loss antenna switching network in order to select individual antenna elements according to the direction required.

Figure 4A:
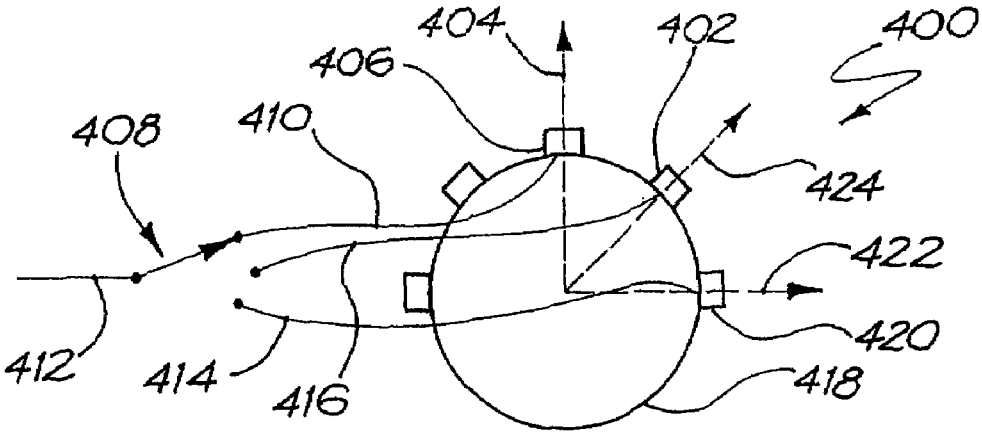
FIG. 4A shows a switched antenna arrangement using the antenna.

FIG. 4A shows a partial switched-element arrangement 400. A general omnidirectional antenna arrangement uses a series of 6 to 8 switched elements comprising small antennas according to the arrangement of FIG. 1, each antenna having a peak gain of at least 8 dBi after switching network losses. The depiction in FIG. 4A is directed to a single 90° quadrant between dashed lines 404 and 422 for ease of description. Three antenna elements 406, 402 and 420 are disposed on an antenna housing 418. The antenna elements 406, 402 and 420 are arranged so that their beam angles point in respective directions depicted by the dashed arrows 404, 424 and 422. The antenna elements 406, 402 and 420 are connected by respective feed lines 410, 416 and 414 to a switch arrangement 408, and thence by means of a connection 412 to the communications apparatus. The apparatus can be a transmitter, a receiver, or a duplexer to which both are connected for simultaneous transmit/receive.

It will be apparent that antennas according to the arrangement of FIG. 1 can also be incorporated into a phased array by introducing a phased array feed network, instead of the switched feed network shown in FIG. 5A, to thereby form a phased array antenna. This is described in more detail in regard to FIGS. 6-14.

Figure 4B:
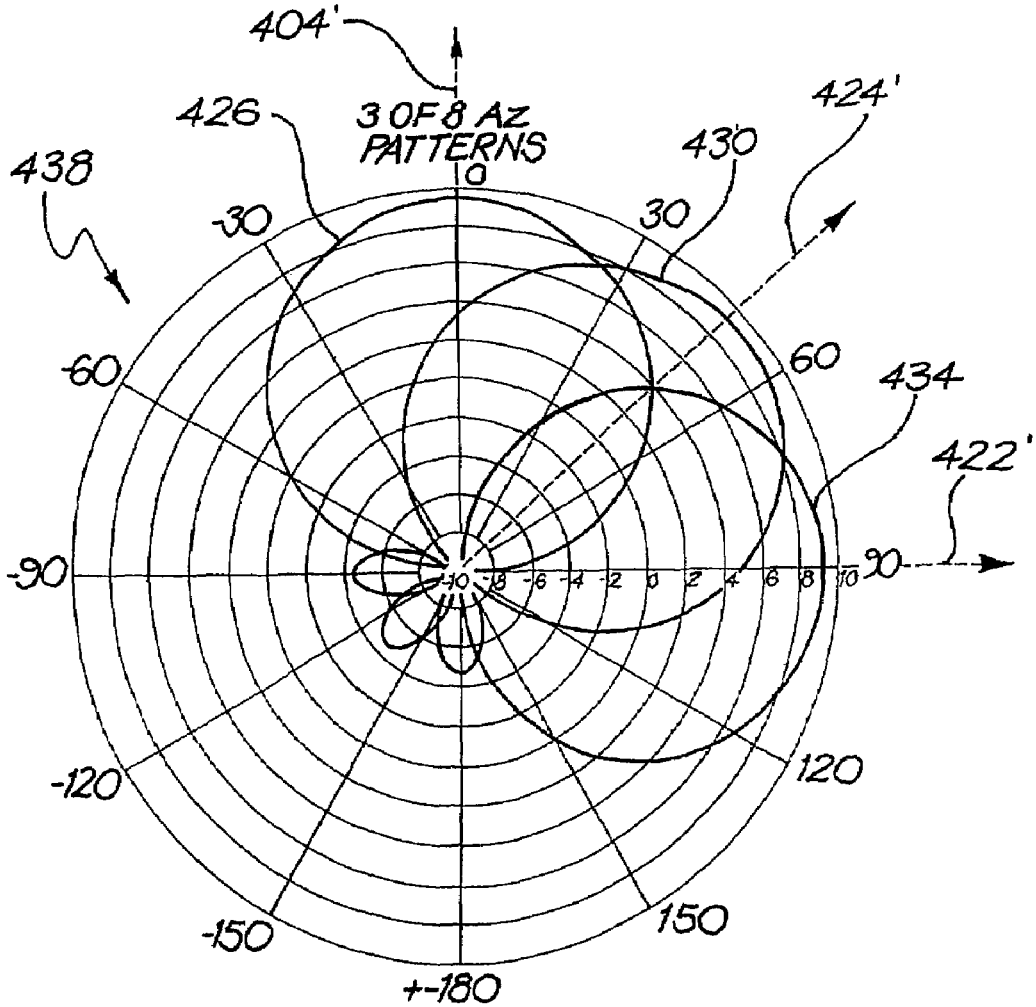
FIG. 4B shows switch azimuth antenna gain patterns for the arrangement shown in FIG. 4A.

FIG. 4B depicts antenna beams 426, 430 and 434 that are associated with the respective antenna elements 406, 402 and 420, the beams being orientated along directions depicted by dashed arrows 404', 424' and 422' which correspond to respective directions 404, 424 and 422 in FIG. 4A.

From an operational perspective the beam 426, for example, can be selected by switching the line 412 to the feed line 410 using the switching arrangement 408. Similarly, the beam 434 can be selected by switching the connection 412 to the feed line 414 using the switching arrangement 408, and so on.

Figure 5:
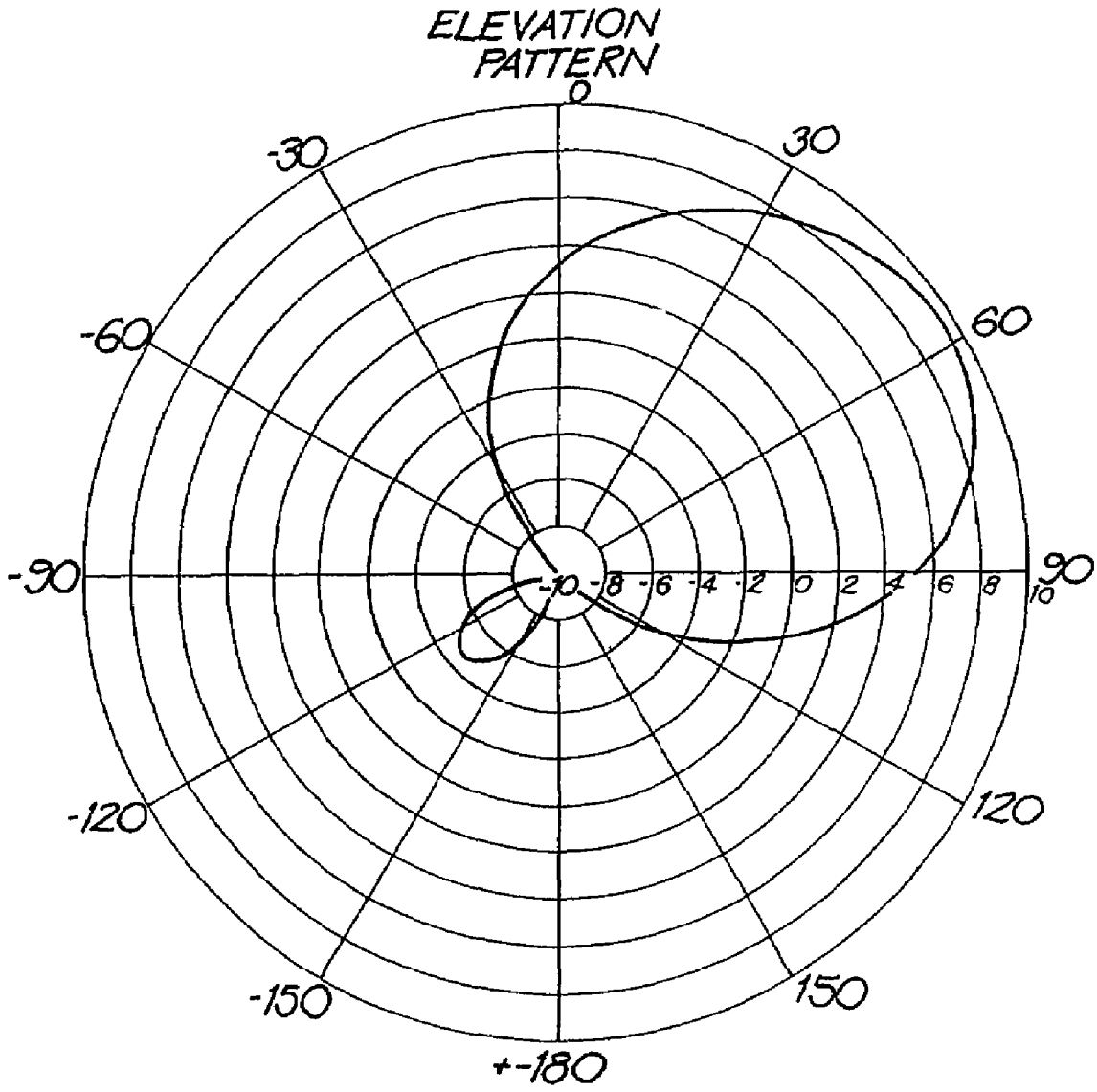
FIG. 5 shows an elevation pattern for the antenna.

FIG. 5 shows an elevation pattern for the antenna shown in FIG. 1. The peak antenna gain is in excess of 9 dB, with broad coverage over elevation angles from 20 to 70 degrees.

The coverage at the zenith may be improved, if required, by incorporating an extra antenna element pointing to the zenith. This element is connected to the switched array 400, for example, to provide coverage at the zenith.

A single helix with only approximate manual pointing of the antenna would also be attractive for non-mobile applications.

Figure 6:
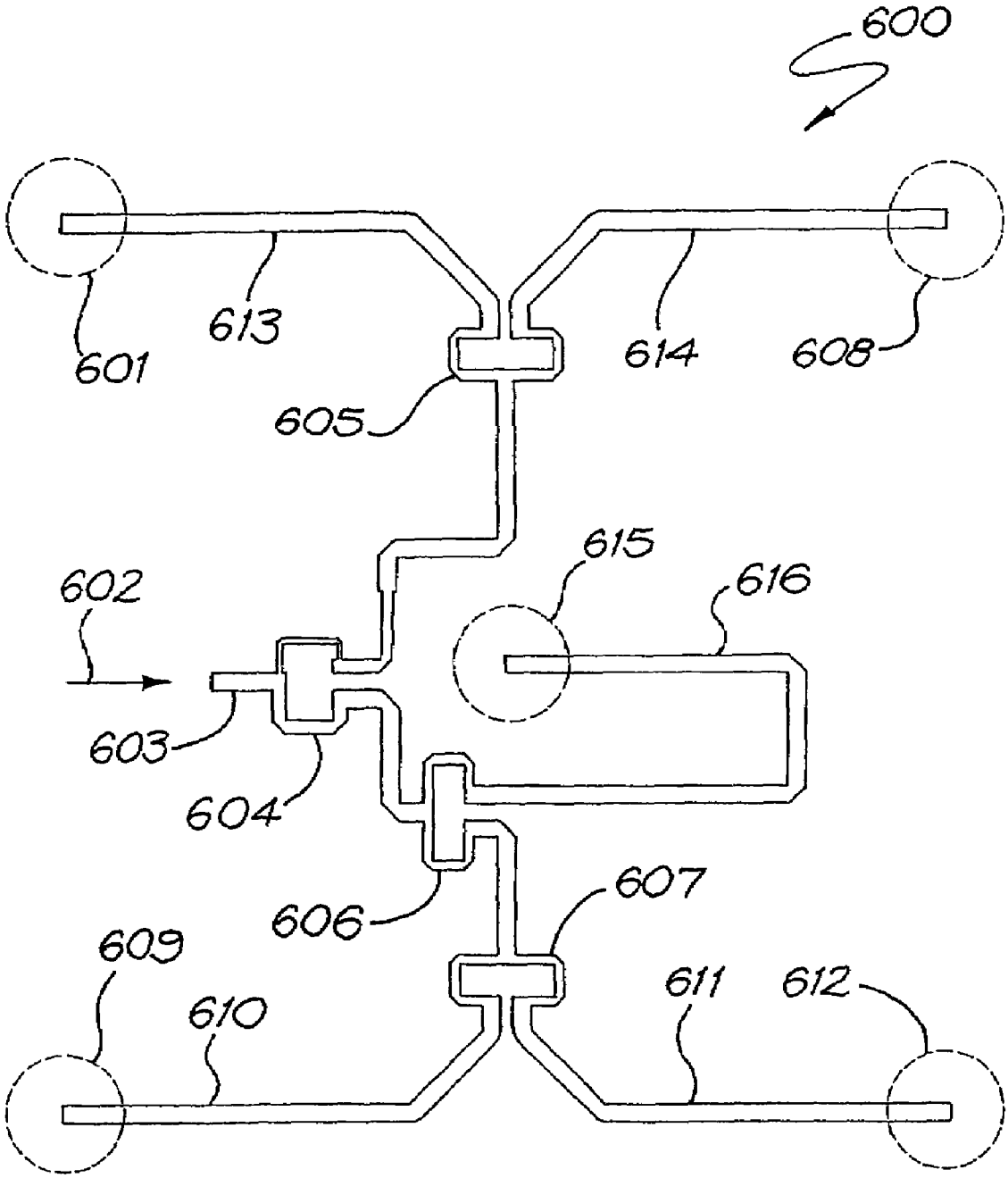
FIG. 6 shows a feed network for a phased array antenna using helix antenna elements.

FIG. 6 shows a feed network 600 for a phased array antenna using five helix antenna elements as previously described, these antenna elements being arranged in a domino configuration. The feed network depicted in FIG. 6 can be implemented in a number of different ways, including microstrip and stripline, for example. When the array antenna in FIG. 6 is used as a transmitting array, a signal 602 is input at 603 and flows through a divider network 604. Energy flows to another divider 605 and is distributed along feed-lines 613 and 614 to respective helix antenna elements 601 and 608. The aforementioned helix antenna elements are shown in dashed form in order not to obscure details of the feed network 600.

The input signal 602 is also distributed by the divider 604 to another divider 606 which provides energy along a feed-line 616 to a helix antenna element 615. The divider 606 also provides signal power to another divider 607 which provides signal along respective feed arms 610 and 611 to respective helix antenna elements 609 and 612.

The feed network 600 is depicted in FIG. 6 as a component in a transmitting array, however it is apparent that the same antenna array can be used as a receive antenna array, in which case the arrow would be directed in the opposite direction.

Equal feed-line lengths are used from the input 603 to each of the radiating elements 601, 608, 615, 609 and 612 in the arrangement 600. Furthermore, the energy delivered to each of the radiating elements is equal, and thus "uniform amplitude weighting" is used in the example shown. It is apparent, however, that variations in feed-line lengths and/or amplitude weighting can be used to achieve specific array antenna characteristics. The antenna elements 601, 608, 615, 609 and 612 are disposed on a common ground plane such as 1211 in FIG. 13.

Figure 7:
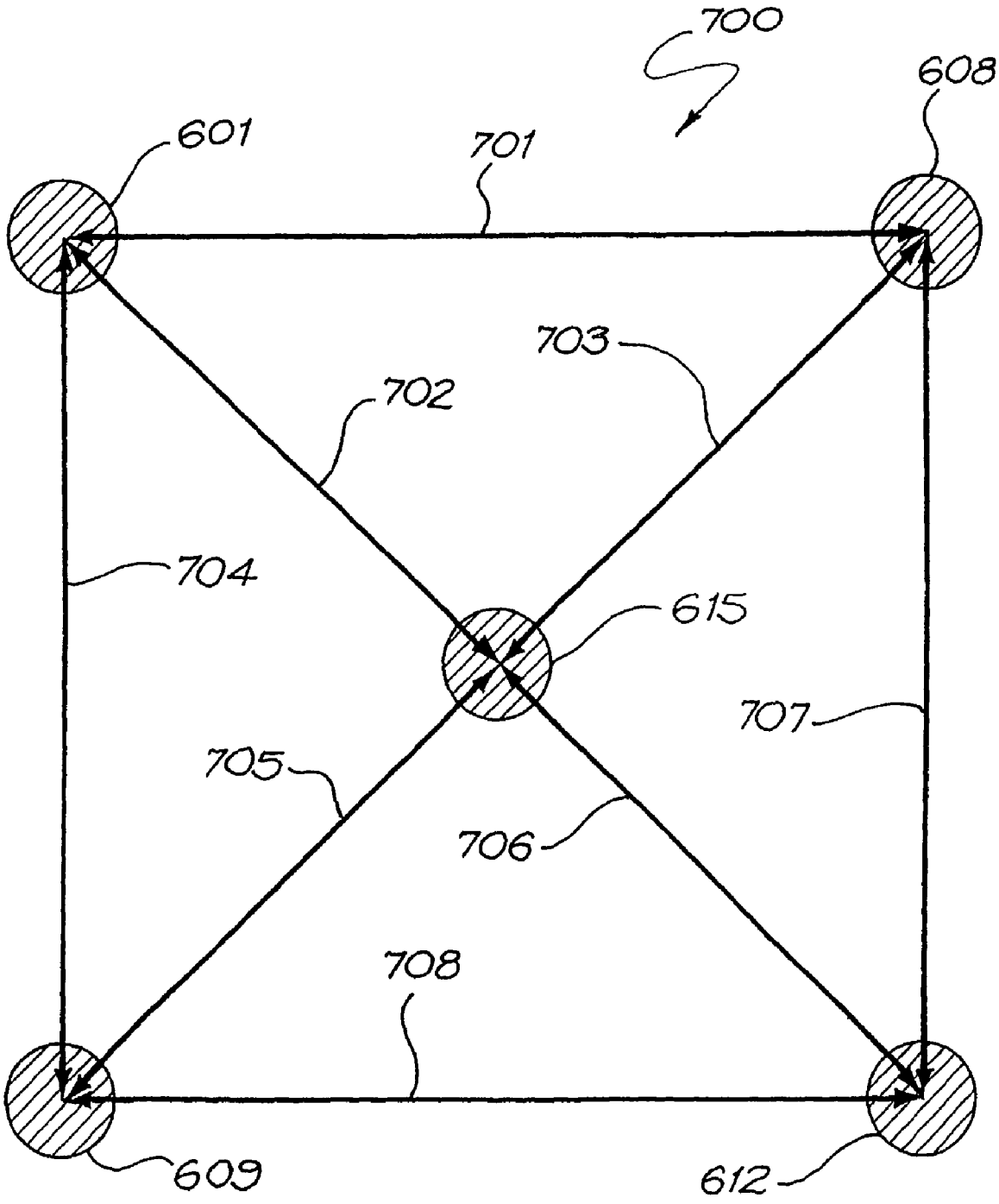
FIG. 7 shows inter-element distances for the array antenna of FIG. 6.

FIG. 7 shows a plan view 700 of the helix antenna elements 601, 608, 615, 609 and 612 without the feed network 600 and in a domino pattern, i.e., pattern of domino pips, here five. The central helix antenna element 615 is located at a radial inter-element distance 702 from the antenna element 601. The radial inter-element distance 702 can vary between 0.51 and 2.51 at the frequency of operation of the antenna array. Radial inter-element distances 705, 706 and 703 are equal to the radial inter-element distance 702. An inter-element distance 701 between the helix antenna elements 601 and 608 can corresponding vary between 0.71 and 3.51 at the frequency of operation of the antenna array. Inter-element distances 704, 708 and 707 are equal in length to the inter-element spacing 701. The inter-element spacings described in relation to FIG. 7 are also applicable to the other array antenna arrangements described in relation to FIGS. 8, 10, 12, 13 and 14.

Figure 8:
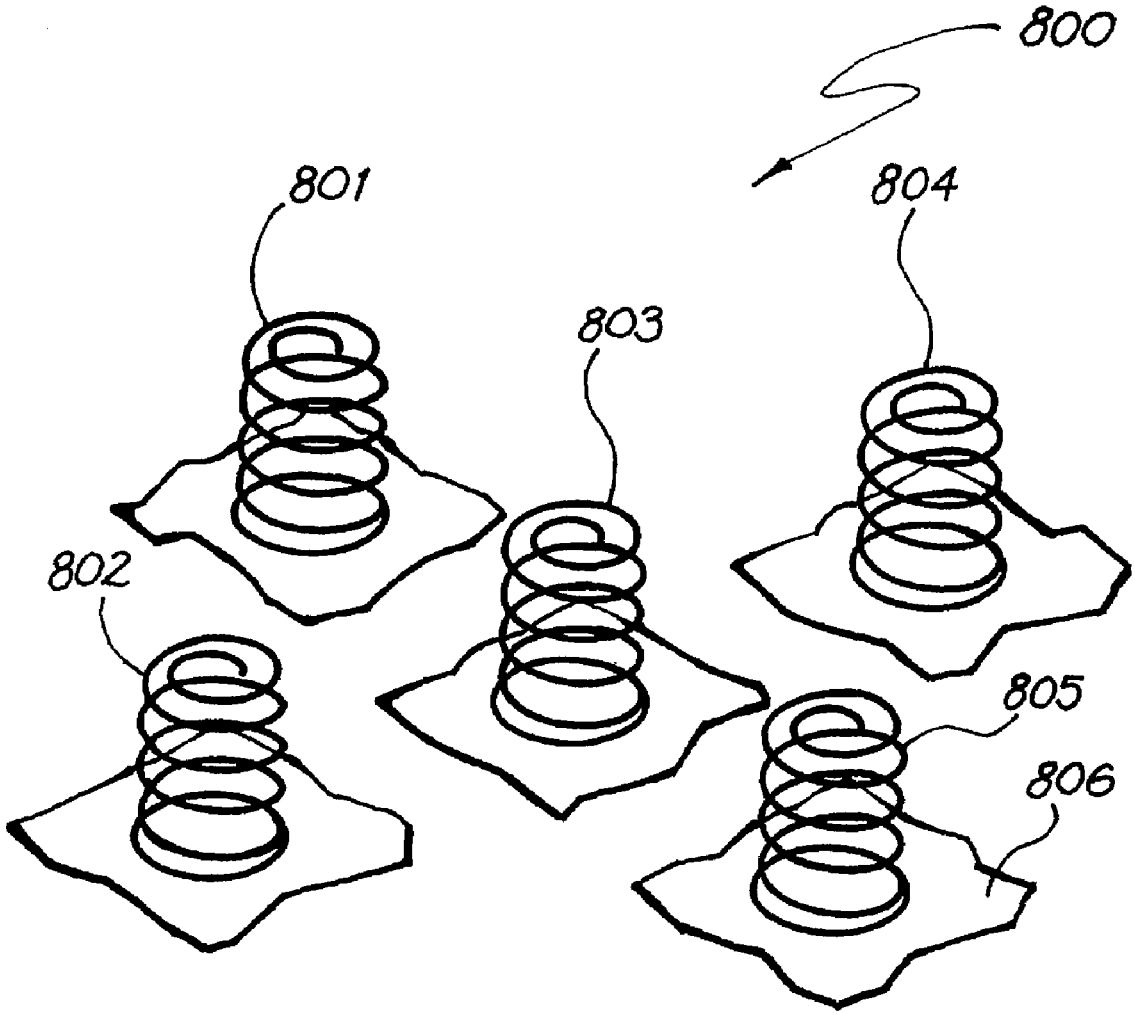
FIG. 8 shows an isometric view the antenna of FIG. 6.

FIG. 8 show an isometric view 800 of five helix antenna elements 801-805, each having five helical turns, that are disposed on a common ground plane with inter-element spacings as shown in FIG. 7. Each helix antenna element 801-805 is shown positioned on a ground plane segment 806, however as noted, all the antenna elements 801-805 are mounted on a common ground plane as will be shown in FIG. 13, for example.

Figure 9:
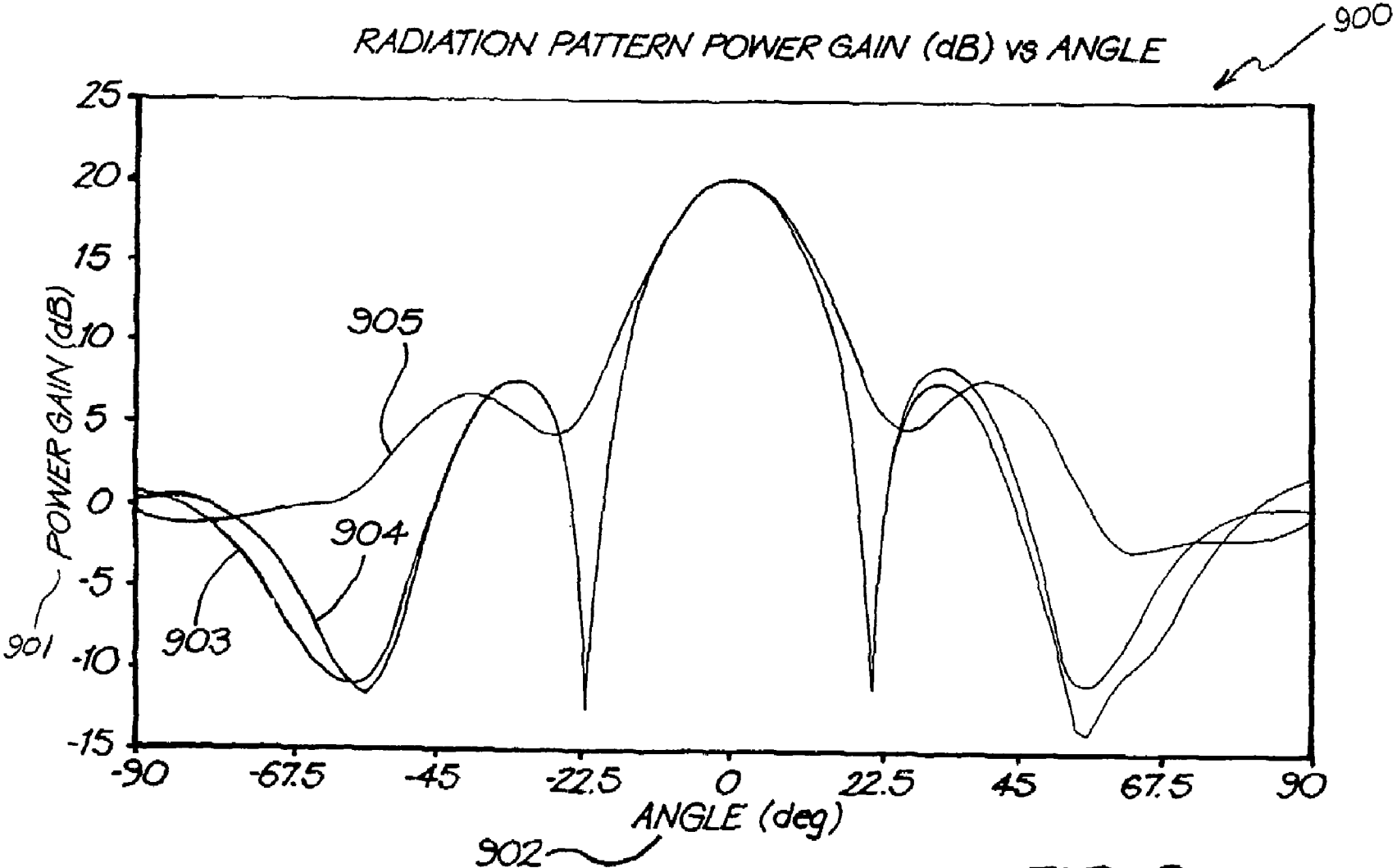
FIG. 9 shows an antenna radiation pattern for the array antenna of FIG. 8.

FIG. 9 shows an antenna radiation pattern 900 for the array antenna of FIG. 8. The gain of the array antenna is plotted against a vertical access 901 depicting power gain in dB and against a horizontal axis 902 which represents angular deviation in degrees. The angular deviation of the horizontal axis 902 is measured with respect to a "boresite" axis of the array depicted in FIG. 8. For the array of FIG. 8, the boresite is the axis of the helix 803, which is equivalent to the axis 100 in FIG. 1. Three antenna gain patterns, depicted by reference numerals 903-905, are shown in FIG. 9, depicting the gain for the array antenna of FIG. 8 measured at relative lateral orientations of 0, 45 and 90 degrees for the array antenna 800.

Figure 10:
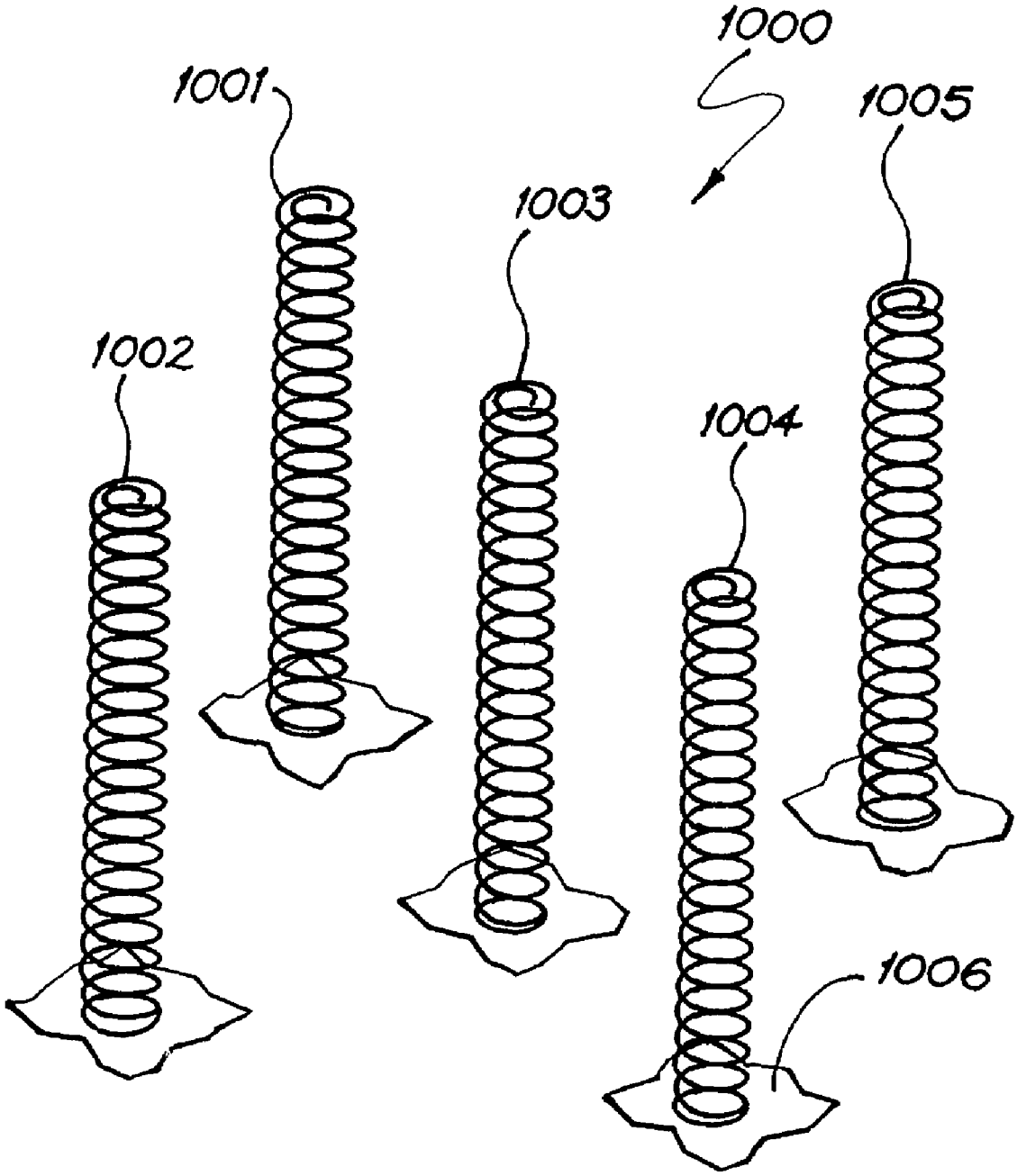
FIG. 10 depicts an array antenna using helix elements each having 20 helical turns.

FIG. 10 depicts an array antenna 1000 similar to that shown in FIG. 8, but using helix elements each having 20 helical turns. It has been found that as the number of turns in the helix element increases, the antenna element axial ratio decreases as well, thereby reducing the need for the spiral terminating element. The helix pitch angle 220 (see FIG. 2) which for low profile helix elements such as are illustrated in FIG. 2 can vary between 3 and 7 degrees referred to the horizontal reference line 222, increases as the number of turns in the helix element increases, the pitch increasing to a value lying between 10-14 degrees. The array 1000 comprises 5 helix antenna elements 1001-1005 which are disposed in a similar pattern to that shown in FIG. 8. The helix elements 1001-1005 are disposed on a common ground plane depicted by 1006.

Figure 11:
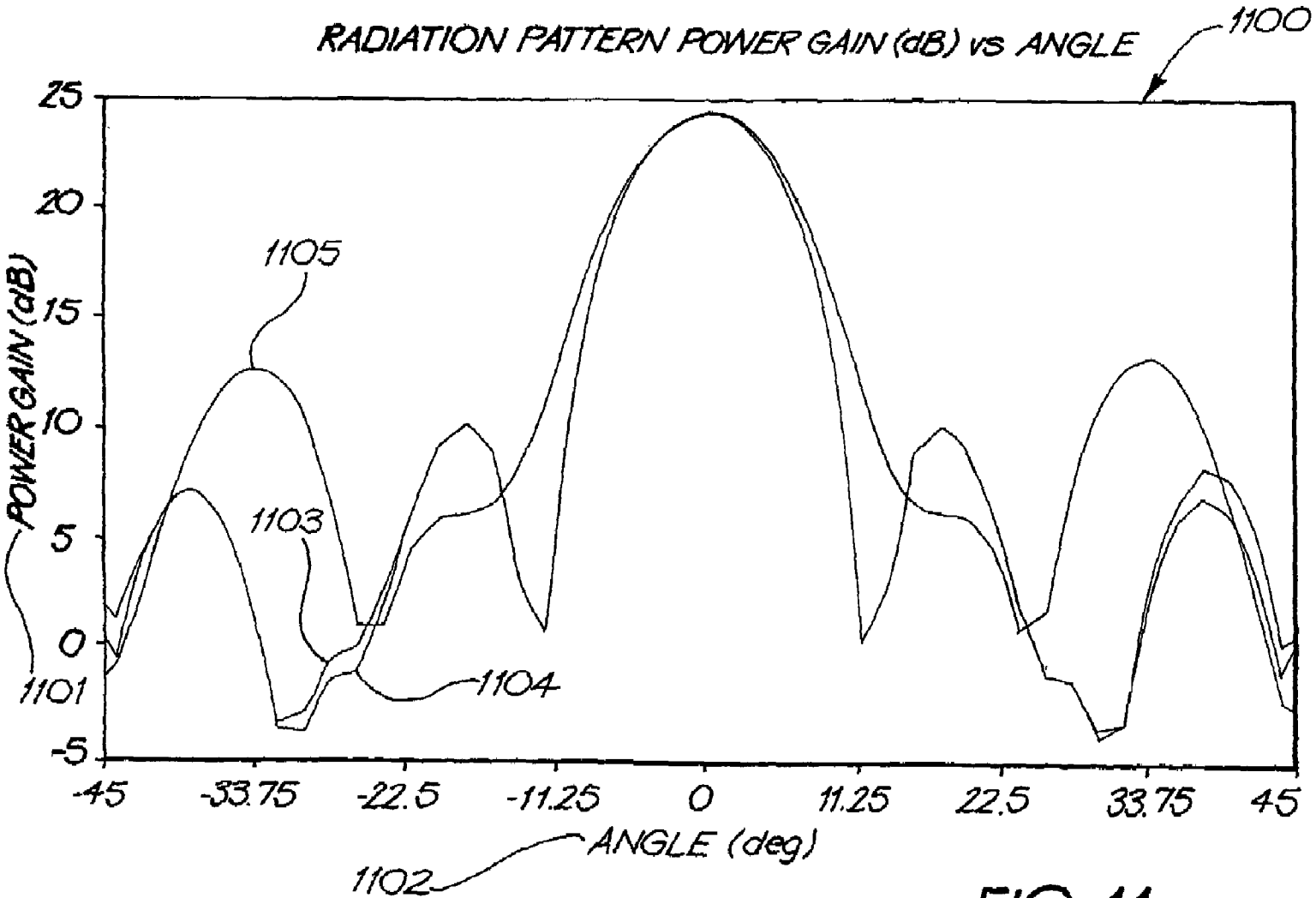
FIG. 11 shows an antenna radiation pattern for the array antenna of FIG. 10.

FIG. 11 depicts an array gain radiation pattern 1100 for the array antenna 1000 of FIG. 10. The radiation pattern is plotted against a vertical axis 1101 depicting power gain in dB and a horizontal axis 1102 depicting angular deviation in degrees from the boresite axis of the array antenna 1000. Three gain patterns 1103-1105 are plotted in FIG. 11, depicting the array antenna gain at relative lateral rotations of 0, 45 and 90 degrees for the array antenna 1000.

Figure 12:
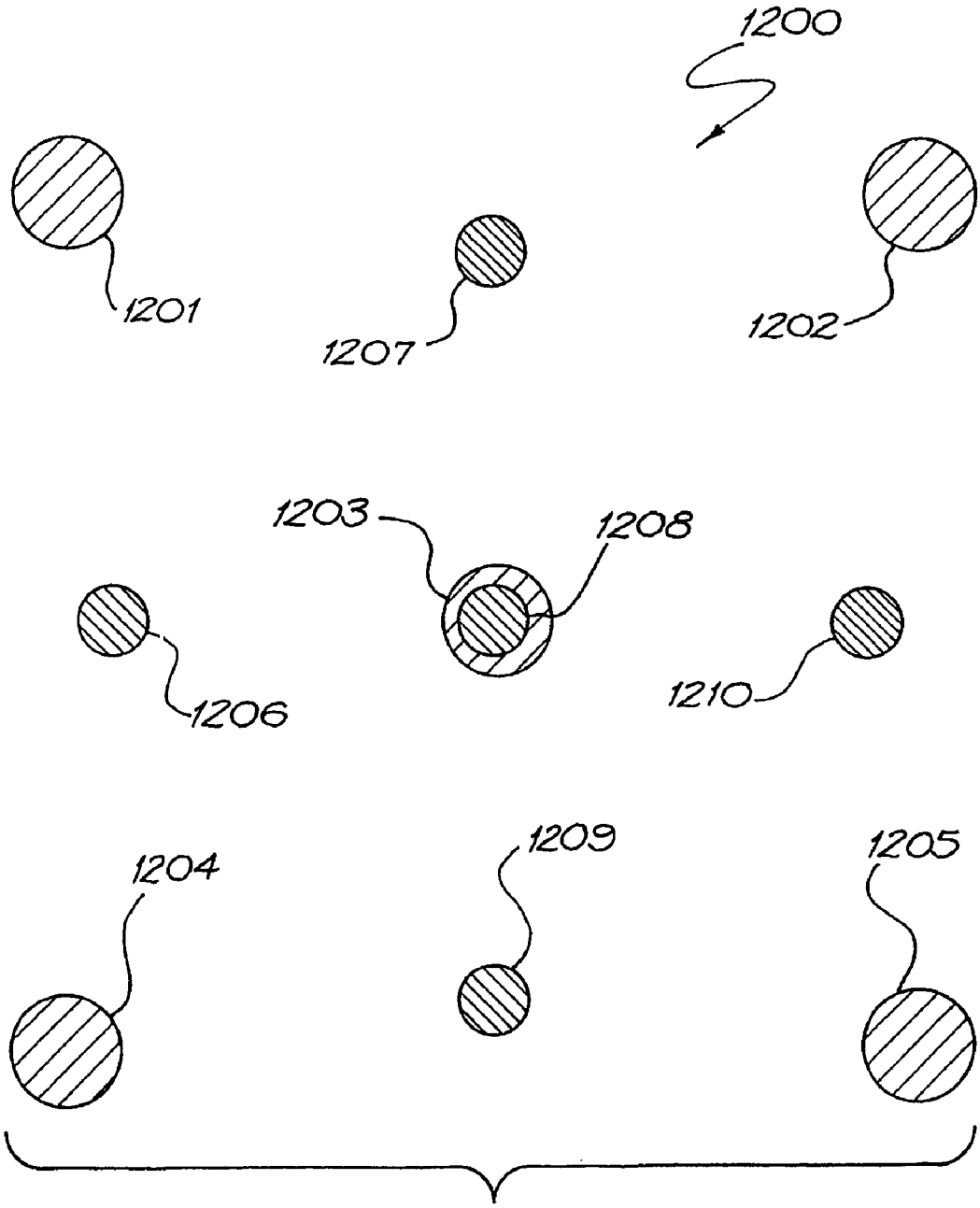
FIG. 12 shows two antenna arrays disposed on a common ground plane.

FIG. 12 shows how two antenna arrays such as those depicted in FIGS. 8 and 10 can be disposed on a common ground plane in order to act, for example, as respective transmit and receive arrays. In FIG. 12 one array is depicted by large hashed circles 1201-1205, while the second array is depicted by smaller hashed-circles 1206-1210. The array constituted by the radiating elements 1206-1210 is laterally rotated with respect to the array consisting of the radiating elements 1201-1205 in order to maximise the inter-element spacing between elements of the two arrays. The inter-element spacing within each distinct array is consistent with the inter-element spacings described in relation to FIG. 7. In FIG. 12 the relative inter-element spacing for the two depicted arrays is different since they operate at different frequencies, one frequency being allocated to the transmit function, and the other frequency being allocated to the receive function.

Figure 13:
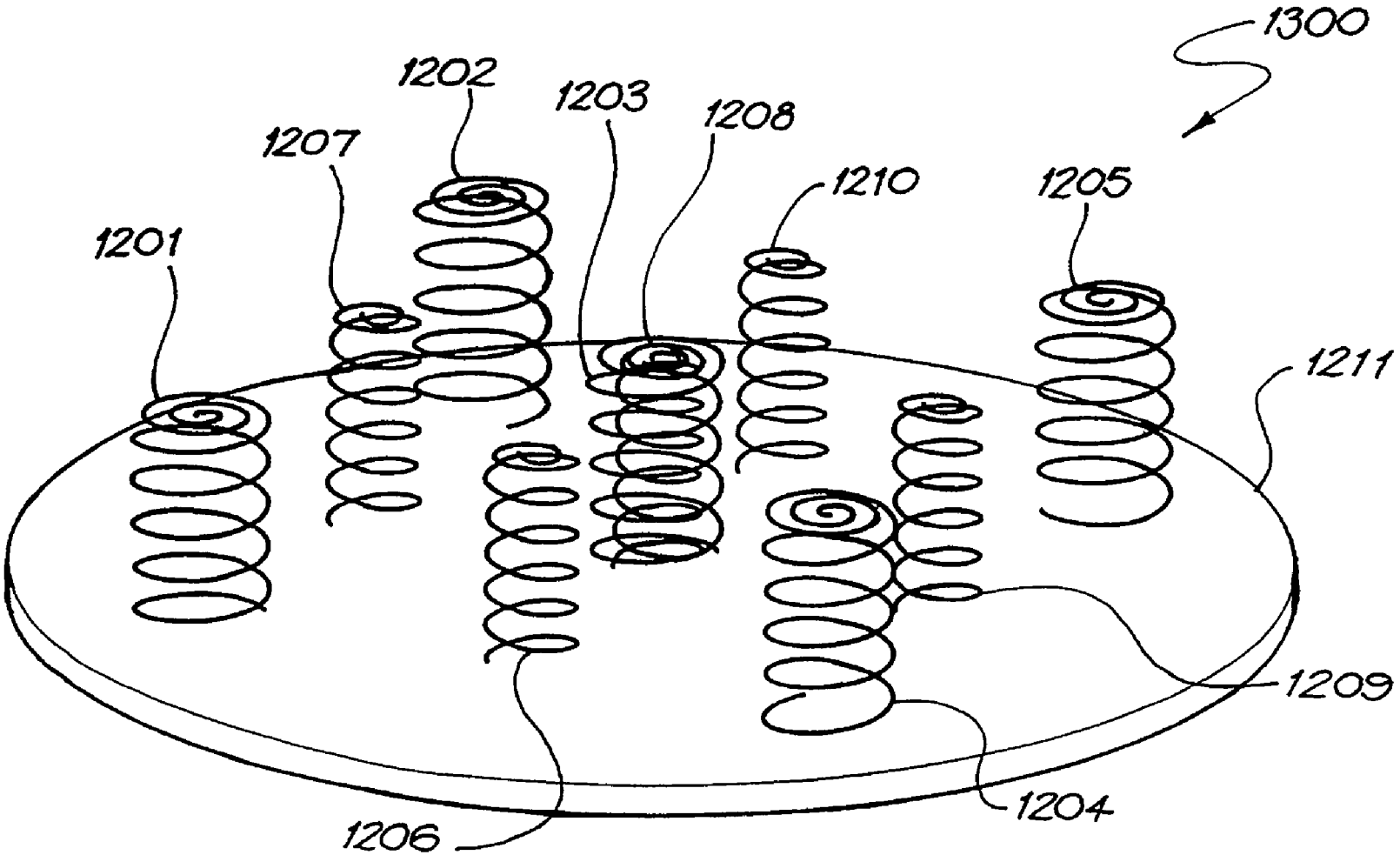
FIG. 13 shows an isometric view of the transmit/receive array of FIG. 12.

FIG. 13 shows an isometric view 1300 of the transmit/receive array of FIG. 12. The individual radiating elements 1201-1205 for the one array and 1206-1210 for the second array are shown mounted on a common ground plane 1211. The central radiating element 1208 is located within the central radiating element 1203.

Figure 14:
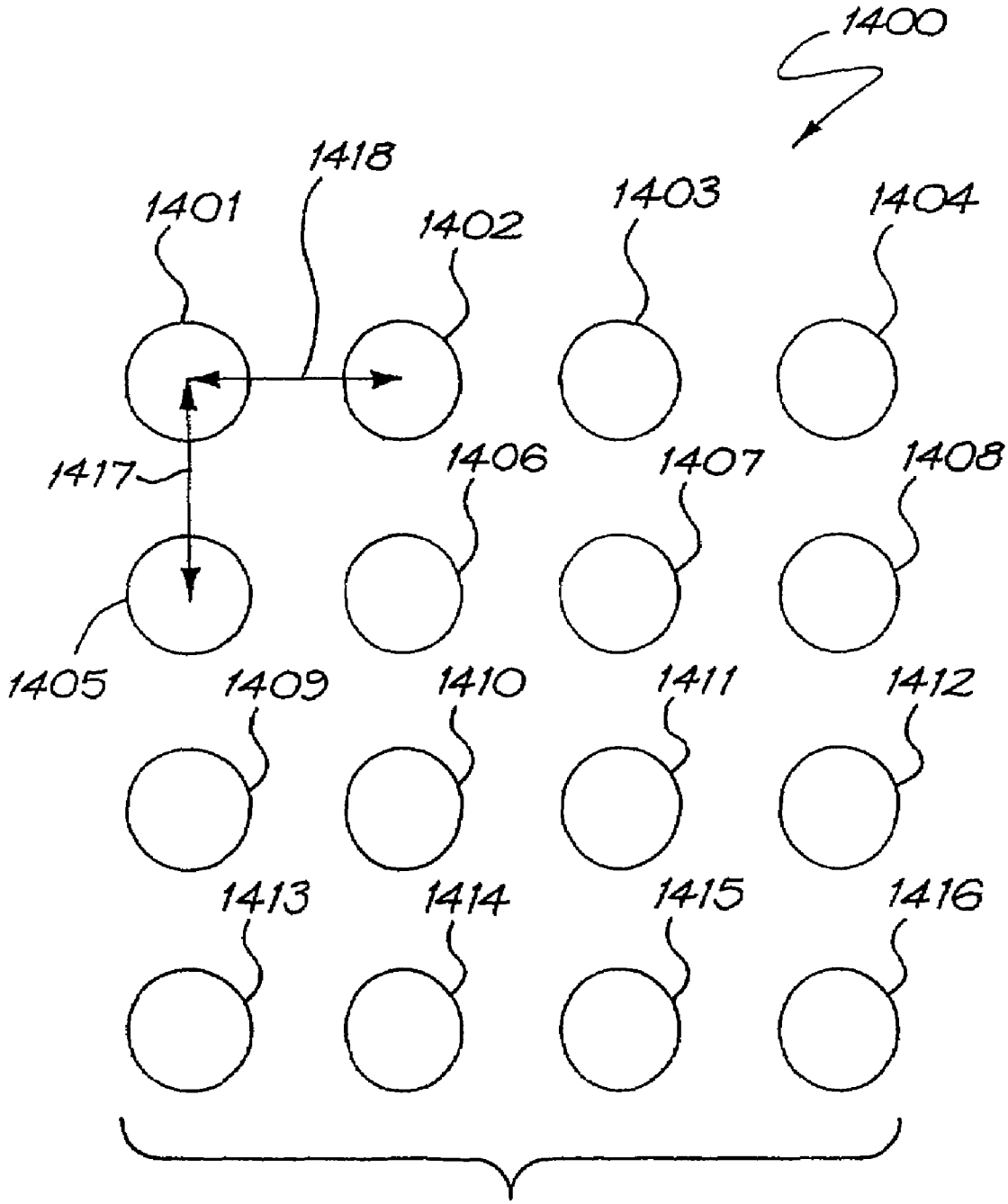
FIG. 14 shows another array antenna using the helix antenna elements.

FIG. 14 shows another arrangement 1400 of an array antenna using the helix antenna elements described in relation to FIGS. 8, 10 and 13. In FIG. 14 helix radiating elements 1401-1416 are arranged in a rectangular grid arrangement with horizontal inter-element spacings depicted by an arrow 1418 and vertical inter-element spacings depicted by an arrow 1417.

INDUSTRIAL APPLICABILITY

It is apparent from the above that the arrangements described are applicable to the mobile communication industry.

The foregoing describes only some embodiments of the present invention, and modifications and/or changes can be made thereto without departing from the scope and spirit of the invention, the embodiments being illustrative and not restrictive.

The invention claimed is:

1. An antenna element comprising:

a ground plane;

a cylindrical helix having a uniform pitch, the cylindrical helix being disposed above the ground plane, the cylindrical helix being connectable to a communications apparatus at a first helix end, the first helix end being located near the ground plane; and a spiral spiraling inward in a flat configuration towards the axis of the cylindrical helix, the spiral having a first end thereof connected to a second helix end, the second helix end being the opposite end of the cylindrical helix to the first helix end, said spiral thereby terminating the antenna element wherein the axis of the cylindrical helix is substantially perpendicular to the ground plane, and the spiral lies in a flat plane that is substantially perpendicular to the axis of cylindrical helix.

2. An antenna element according to claim 1, further including a tapered transmission line connected between the communications apparatus and the first end of the cylindrical helix located near the ground plane.

3. An antenna element according to claim 1, wherein:

the cylindrical helix has (a) between 1.5 and 3.5 turns, (b) a pitch angle of between 3 and 7 degrees, and (c) a circumference of between 0.9 and 1.15 wavelengths; and the spiral has between 1 and 4 turns.

4. An antenna element according to claim 1, wherein:

the cylindrical helix has (a) between 3.5 and 4.0 turns, (b) a pitch angle of between 10 and 14 degrees, and (c) a circumference of between 0.9 and 1.15 wavelengths; and the spiral has between 1 and 4 turns.

5. An antenna comprising:

a switched element feed network having an equipment feed-line for connection to communication apparatus and a plurality of element feed-lines for connection to a like plurality of cylindrical helix antenna elements according to claim 1, said switched element feed network being adapted to connect a selected one of the cylindrical helix antenna elements to the communication apparatus; and said plurality of cylindrical helix antenna elements, said cylindrical helix antenna elements being disposed above said ground plane, each said cylindrical helix antenna element being individually connectable at a respective said first helix end located near the ground plane to a respective element feed-line of the switched element feed network to thereby connect to the communications apparatus.

6. An antenna comprising:

a phased array feed network having an equipment feed-line for connection to communication apparatus and a plurality of element feed-lines for connection to a like plurality of cylindrical helix antenna elements according to claim 1, said phased array feed network being adapted to collectively connect said plurality of cylindrical helix antenna elements to the communication apparatus; and said plurality of cylindrical helix antenna elements, said cylindrical helix antenna elements being disposed above said ground plane, each said cylindrical helix antenna element being individually connectable at a respective said first helix end located near the graund plane to a respective element feed-line of the phased array feed network to thereby connect to the communications apparatus.

7. An antenna according to claim 6, wherein:

the plurality of cylindrical helix antenna elements are arranged on a square grid in groups of five; and each of the groups is arranged with (a) four members on grid intersection points of the grid and (b) a fifth member at the centre of the four members.

8. An antenna comprising:

a phased array feed network having an equipment feed-line for connection to communication apparatus and a plurality of element feed-lines for connection to a like plurality of cylindrical helix antenna elements, said phased array feed network being adapted to collectively connect said plurality of cylindrical helix antenna elements to the communication apparatus; and said plurality of cylindrical helix antenna elements arranged in a pattern of domino pips, on a square grid in groups of five wherein each said group is arranged with (a) four members of the group on gird intersection points and (b) the fifth member of the group at the centre of said four members, each said cylindrical helix antenna element comprising a ground plane and a cylindrical helix having a uniform pitch disposed above the ground plane, each said cylindrical helix antenna element being individually connectable at a respective first cylindrical helix end located near the ground plane to a respective element feed-line of the phased array feed network to thereby connect said cylindrical helix antenna element to the communications apparatus, wherein each said cylindrical helix antenna element further comprises a spiral spiraling inwards in a flat configuration towards on the axis of the cylindrical helix thel spiral having a first end thereof connected to a second helix end being the opposite end of the cylindrical helix to the first helix end, said spiral thereby terminating the antenna wherein the axis of the cylindrical helix is substantially perpendicular to the ground plane, and the spiral lies in a flat plane that is substantially perpendicular to the axis of the helix.

9. An antenna according to claim 7, wherein:

in regard to a said group of five elements the radial inter-element spacing between the centre antenna element and antenna elements on said corners grid intersection points is between 0.5λ and 2.5λ at the frequency of operation of the antenna.

10. An antenna having two antennas according to claim 7, wherein:

a centre cylindrical helix antenna element of a first of said two antennas is co-located with a centre cylindrical helix antenna element of a second of said two antennas; and the first of said two antennas is laterally rotated with respect to the second of said two antennas, said lateral rotation being about a common axis of the co-located centre cylindrical helix antenna elements to thereby change inter-element spacing between antenna elements of said two antennas.

11. An antenna comprising:

a ground plane;

a plurality of cylindrical helices disposed above the ground plane, each said cylindrical helix being connectable, via a respective feed line of an associated phased array feed network to a communications apparatus, at a respective first helix end located near the ground plane; and a like plurality of spirals, each spiraling inwards in a flat configuration towards the axis of the corresponding one of the plurality of cylindrical helices, said each lateral spiral having a first end thereof connected to a second helix end of the corresponding one of the plurality of helices, said second helix end being the opposite end of the cylindrical helix to the first helix end, said spiral thereby terminating the corresponding helix;

wherein the axis of the cylindrical helix is substantially perpendicular to the ground plane, and the spiral lies in a flat plane that is substantially perpendicular to the axis of the helix.

12. An antenna comprising:

a ground plane;

a plurality of cylindrical helices disposed above the ground plane, each said cylindrical helix being connectable, via a respective feed line of an associated switched element feed network to a communications apparatus, at a respective first helix end located near the ground plane; and a like plurality of spirals, each spiraling inward in a flat configuration towards the axis of the corresponding one of the plurality of cylindrical helices, said each spiral having a first end thereof connected to a second helix end of the corresponding one of the plurality of cylindrical helices, said lateral spiral thereby terminating the corresponding helix;

wherein the axis of the cylindrical helix is substantially perpendicular to the ground plane, and the spiral lies in a flat plane that is substantially perpendicular to the axis of the helix.

13. An antenna comprising:

a phased array feed network having an equipment feed-line for connection to communication apparatus and a plurality of element feed-lines for connection to a like plurality of cylindrical helix antenna elements, said phased array feed network being adapted to collectively connect said plurality of cylindrical helix antenna elements to the communication apparatus; and said plurality of cylindrical helix antenna elements according to claim 1, said helix antenna elements being disposed above said ground plane and arranged in a rectangular grid pattern having a first spacing between rows of said rectangular grid pattern and a second spacing between columns of said rectangular grid pattern, each said cylindrical helix antenna element being individually connectable at a respective first helix end located near the ground plane to a respective element feed-line of the phased array feed network to thereby connect to the communications apparatus.

14. A method of impedance matching a cylindrical helix antenna element wherein the cylindrical helix antenna element comprises a graund plane, a cylindrical helix having a uniform pitch disposed above the ground plane, the cylindrical helix being connectable to a communications apparatus at a first helix end located near the ground plane, and a spiral spiraling inward in a flat configuration towards the axis of the cylindrical helix the spira1 having a first end thereof connected to a second helix end, said second helix end being the opposite end of the cylindrical helix to the first helix end, said spiral thereby terminating the cylindrical helix antenna, wherein the axis of the cylindrical helix is substantially perpendicular to the ground plane, and the spiral lies in a flat plane that is substantially perpendicular to the axis of the helix, said method comprising the steps of:

adjusting a distance, from the ground plane, of the first helix end located near the ground plane to thereby adjust the impedance of a tapered transmission line formed between the ground plane and a first quarter turn of the cylindrical helix.

15. An antenna according to claim 8, wherein:

having regard to a said group of five elements, the radial inter-element spacing between the centre antenna element and antenna elements on said grid intersection points is between 0.5λ and 2.5λ at the frequency of operation of the antenna.

16. An antenna having two antennas according to claim 8, wherein:

a centre cylindrical helix antenna element of a first of said two antennas is co-located with a centre cylindrical helix antenna element of a second of said two antennas; and the first of said two antennas is laterally rotated with respect to the second of said two antennas, said lateral rotation being about a common axis of the co-located centre cylindrical helix antenna elements to thereby change inter-element spacing between antenna elements of said two antennas.

* * * * *